US009353773B2

(12) United States Patent
Lilie et al.

(10) Patent No.: US 9,353,773 B2
(45) Date of Patent: May 31, 2016

(54) MOUNTING ARRANGEMENT FOR A SUCTION MUFFLER IN A LINEAR MOTOR COMPRESSOR

(75) Inventors: Dietmar Erich Bernhard Lilie, Joinville-Sc (BR); Rinaldo Puff, Joinville-Sc (BR)

(73) Assignee: Whirlpool S.A., São Paulo-Sp (BR)

( * ) Notice: Subject to any disclaimer, the term of this patent is extended or adjusted under 35 U.S.C. 154(b) by 396 days.

(21) Appl. No.: 13/988,832

(22) PCT Filed: Nov. 24, 2011

(86) PCT No.: PCT/BR2011/000438

§ 371 (c)(1),
(2), (4) Date: Jul. 12, 2013

(87) PCT Pub. No.: WO2012/068658

PCT Pub. Date: May 31, 2012

(65) Prior Publication Data

US 2013/0312598 A1 Nov. 28, 2013

(30) Foreign Application Priority Data

Nov. 24, 2010 (BR) ..... 1004881

(51) Int. Cl.

| | |
|---|---|
| ***F15B 15/00*** | (2006.01) |
| ***F04B 19/22*** | (2006.01) |
| *F04B 7/02* | (2006.01) |
| *F04B 39/00* | (2006.01) |

(52) U.S. Cl.

CPC ..... *F15B 15/00* (2013.01); *F04B 19/22* (2013.01); *F04B 39/0005* (2013.01); *F04B 39/0061* (2013.01); *F04B 39/0072* (2013.01); *F04B 7/0216* (2013.01); *F04B 39/0016* (2013.01)

(58) Field of Classification Search

CPC ..... F04B 39/0061; F04B 39/0072; F04B 39/0005; F04B 39/0016; F04B 19/22

USPC ..... 417/415–417

See application file for complete search history.

(56) References Cited

U.S. PATENT DOCUMENTS 5,947,708 A * 9/1999 Park ..... C07K 14/65 137/856
5,993,178 A * 11/1999 Park ..... F04B 35/045 417/416

(Continued)

FOREIGN PATENT DOCUMENTS

| | | | |
|---|---|---|---|
| EP | 1959139 | A2 | 8/2008 |
| WO | 2004106737 | A1 | 12/2004 |

OTHER PUBLICATIONS

International Search Report and Written Opinion dated Nov. 24, 2011, International Application No. PCT/BR2011/000438.

*Primary Examiner* — Peter J Bertheaud
*Assistant Examiner* — Dominick L Plakkoottam
(74) *Attorney, Agent, or Firm* — Dinsmore & Shohl LLP

(57) ABSTRACT

The mounting arrangement is applied to a compressor which comprises: a piston having a cylindrical tubular body; and an actuating means connected to the piston to drive the latter in a reciprocating movement. The suction muffler comprises two tubular inserts, longitudinally disposed in the interior of the piston and having spaced apart open adjacent ends, and closed opposite ends respectively affixed to the top wall of the piston and to the actuating means, and defining, in the interior of the piston, a muffling chamber (C) and an annular passage medianly opened to the muffling chamber (C) and communicating an open rear end of the piston with a suction valve provided in a top wall of said piston.

25 Claims, 4 Drawing Sheets

(56) References Cited

U.S. PATENT DOCUMENTS

2004/0145247 A1* 7/2004 Lilie ..... H02K 33/02
310/156.01

2005/0142002 A1 6/2005 Kang et al.

2005/0175482 A1* 8/2005 Park ..... F04B 35/045
417/416

* cited by examiner

MOUNTING ARRANGEMENT FOR A SUCTION MUFFLER IN A LINEAR MOTOR COMPRESSOR

FIELD OF THE INVENTION

The present invention refers to a constructive arrangement, which allows mounting a suction muffler in a refrigeration compressor driven by a linear motor and, more specifically, to a constructive arrangement for mounting the suction muffler in the interior of the compressor piston, which presents a cylindrical tubular body having an end closed by a top wall provided with a suction valve and which houses, in its interior, a suction acoustic muffler.

BACKGROUND OF THE INVENTION

The compressors of the type considered herein, which are used in refrigeration systems and driven by a linear electric motor, comprise a generally hermetic shell, which houses a non-resonant assembly, including a crankcase.

In this known type of construction, the crankcase incorporates a cylinder, inside which is defined a compression chamber having an end generally closed by a valve plate and by a head, and an open opposite end, through which is mounted a piston reciprocating in the interior of the cylinder and defining, with the latter and with the valve plate, the compression chamber.

The piston is coupled, generally by means of a rod, to an actuating means, which carries magnets energized by the linear motor mounted to the crankcase.

The piston used in the present compressor presents a cylindrical tubular body with an open rear end and a front end closed by a top wall which carries a suction valve. The cylindrical tubular body defines a piston tubular skirt portion which is closed, close to an end edge, by the top wall (defining a head portion in the piston). In some conventional constructions, such as that illustrated in the Brazilian patent document PI 1000181-6, the piston is obtained in a single piece. The cylindrical tubular body has its length calculated as a function of the piston balance inside the cylinder, and of the sealing provided close to the inner wall of said cylinder to avoid compressed gas leakage during the compression cycle of the compressor operation.

The rod is provided internally to the piston and presents a first end affixed to the piston, in the region of the top wall thereof, and a second end affixed to the actuating means.

The linear motor drives the actuating means in a reciprocating movement and is responsible for generating the thrust necessary for displacing the piston in the interior of the compression chamber of the cylinder and, accordingly, for compressing the refrigerant fluid in the form of gas. The piston, the rod and the actuating means form a movable assembly of the compressor, to said movable assembly being coupled a resonant spring which is mounted in a manner to exert opposite axial forces on the piston, upon its reciprocating axial displacement in the interior of the compression chamber. The resonant spring operates as a guide for the axial displacement of the piston, and also actuates on the compression movable assembly, jointly with the linear motor of the compressor. The compression movable assembly and the resonant spring define the resonant assembly of the compressor.

In some constructions, the suction of the refrigerant fluid occurs through the piston. For these constructions, the top wall of the piston presents suction openings, which are selectively closed by the suction valve generally mounted to a front face of said top wall, as described and illustrated in said Brazilian patent document PI 1000181-6.

In some linear compressor constructions in which the suction is carried out through the piston, it may be necessary to mount, in the interior thereof, a noise muffler (suction muffler), for inhibiting the transmission, via gas, of different frequencies coming from the gas flow through the suction valve and from the movement of said suction valve.

Moreover, in order to reduce the variability of the natural frequency of the compressor operation, it is necessary, in determined cases, to add an extra mass to the movable assembly, known as tuning mass, in order to reduce the natural frequency of the mechanism.

Document NZ526361 (WO2004/106737) presents a constructive form for a piston in whose interior is defined a suction muffler means (as illustrated in FIGS. 30 and 31 of said document).

In this construction, part of the interior of the piston defines, directly with its inner wall, a pair of muffling chambers separated from one another by a dividing wall mounted around the rod portion which joins the piston to the actuating means. The muffling chambers are in fluid communication with each other, through windows provided in the dividing wall. The muffling chambers define a first noise muffler for some of the frequencies generated during the gas suction operation through the interior of the piston.

Besides the first noise muffler, said previous construction further presents, in the interior of the piston body, a second muffler which takes the form of a Helmholtz resonator, provided adjacent to an open end of the piston and which is constructed to attenuate the frequencies close to that generated by the compressor operation (medium frequencies). This second muffler takes the form of an insert provided in a single piece and having a closed end, mounted around a tubular axial extension of the actuating means and which surrounds the rod, and an opposite end mounted to the actuating means. Said insert is provided with an opening turned to an annular passage defined between the external wall of the insert and the internal wall of the cylindrical body of the piston. This second suction muffler defines a Helmholtz resonator which, in this previous solution, attenuates the medium frequencies.

The same construction, described and illustrated in document WO2004/106737, further comprises a third noise muffler, in the form of a tubular insert provided in a single piece and having a closed end and an end that is opened to the annular passage defined between the external wall of the second muffler and the internal wall of the cylindrical body of the piston. This third muffler attenuates the high frequencies.

Although this construction of suction muffler provided internal to the piston is defined with the purpose of providing noise attenuation in different frequencies, said construction is only efficient when each operation frequency to be attenuated is very specific. Besides, for the attenuation of frequency bands, said previous construction does not comply with a desired acoustic dampening performance.

Besides said deficiency in the acoustic performance, this previous solution is constructively complex, requiring higher precision for manufacturing the parts which compose the acoustic muffling means, as well as greater attention and a longer assembly time.

Another drawback of said solution, which can also be applied to other known compressor solutions, refers to the difficulty in avoiding or controlling the variability of the natural frequency of the compressor operation, which requires, in determined cases, the provision of adding an extra mass (tuning mass) to the movable assembly of the compressors, as an attempt'to reduce the natural frequency generated by the operation of the compressor mechanism.

Objects of the Invention

Thus, it is an object of the present invention to provide a constructive arrangement which allows, in an easy and efficient manner, mounting a suction muffler in the interior of the piston of a linear motor compressor, without submitting the components of the movable assembly of the compressor to risks of breakage or other damage which can impair its adequate operation, ensuring reliability to the compressor during its entire useful life.

Another object of the present invention is to provide an arrangement, as cited above, and which allows a frequency band to be efficiently attenuated.

An additional object of the present invention is to provide a mounting arrangement of the type presented above and which allows, by means of the muffler structure, carrying out different adjustments in the tuning mass in the compressor, in order to reduce the natural frequency generated by the operation of the compressor mechanism, generally eliminating the need of providing an extra mass to the movable assembly.

SUMMARY OF THE INVENTION

These and other objects are attained through a mounting arrangement for a suction muffler in a linear motor compressor of the type which comprises a movable assembly formed by: a piston having a cylindrical tubular body with an open rear end and a front end closed by a top wall which carries a suction valve; and, an actuating means connected to the piston for driving it in a reciprocating movement.

According to the invention, the piston houses, internally, a suction muffler comprising two tubular inserts longitudinally disposed in the interior of the piston, said tubular inserts having open adjacent ends, spaced from each other, and closed opposite ends respectively affixed to the top wall of the piston and to the actuating means, said tubular inserts defining, in the interior of the cylindrical tubular body of the piston, a muffling chamber and an annular passage, which is medianly opened to the muffling chamber, through the adjacent ends of the tubular inserts, and communicating the open rear end of the piston with its suction valve.

According to a particular form of the present invention, the two tubular inserts are cylindrical and concentric to each other, but not necessarily with the same diameter, their adjacent ends being mutually confronting.

According to the present invention, the suction acoustic muffler provided in the interior of the piston is generally of the tube-volume-tube type, acting for attenuating the frequencies higher than a determined cutoff frequency. In acoustic terms, the attenuation obtained above the cutoff frequency results from the areas and lengths of the annular passages (tubes) and from the intermediary volume. The total passage area is calculated so as not to result in load loss.

Moreover, the acoustic muffler, in the piston construction of the present invention, also acts as a tuning mass, avoiding the need of providing additional masses in the compressor.

BRIEF DESCRIPTION OF THE DRAWINGS

The invention will be described below, with reference to the enclosed drawings, given by way of example of an embodiment of the invention and in which.

DESCRIPTION OF THE ILLUSTRATED CONSTRUCTIONS

The present invention refers to a refrigeration compressor provided with a linear motor and comprising, in the interior of a generally hermetic shell, the same basic components described in the introduction of the present specification. As described, the compressor comprises a crankcase incorporating a cylinder, which has an end generally closed by a valve plate, and an open opposite end through which is mounted a piston 10.

Figure 1:
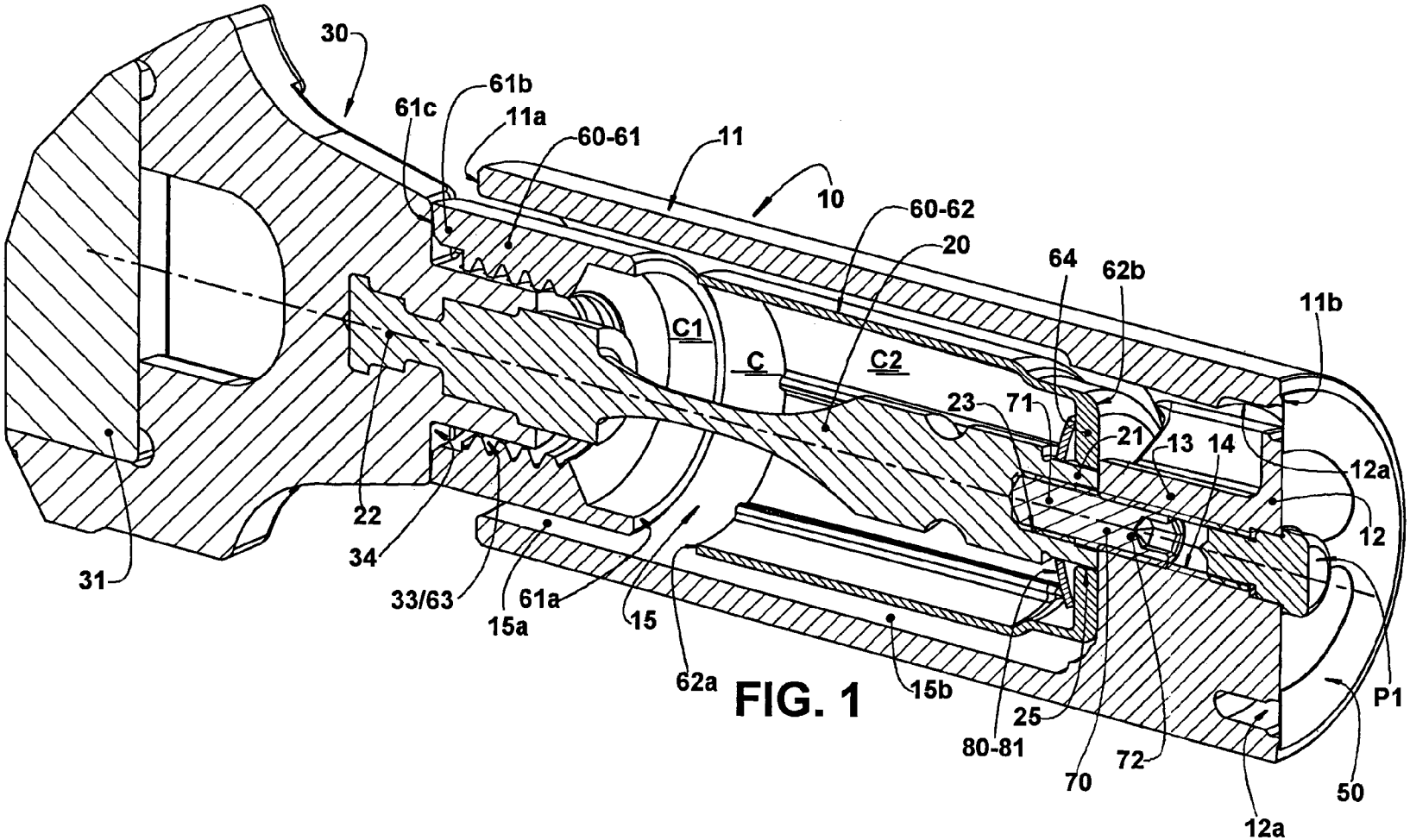
FIG. 1 represents a partially cut schematic perspective view of the movable assembly of a linear compressor, whose piston is internally provided with a suction muffler, constructed according to a first embodiment of the present invention.

The piston 10 is coupled, by means of a rod 20, to an actuating means 30, which carries the known magnets 31 (only one is illustrated in FIG. 1) energized by a linear motor (not illustrated), to provide the reciprocating movement to the actuating means 30.

The piston 10, the rod 20 and the actuating means 30 form a movable assembly of the compressor, to which movable assembly is coupled a resonant spring (not illustrated), mounted in a manner to exert opposite axial forces on the piston 10, upon the reciprocating axial displacement of the latter. The compression movable assembly (with the not illustrated resonant spring) defines the resonant assembly of the compressor.

The piston 10 presents a cylindrical tubular body 11 with an open rear end 11*a*, and a front end 11*b* closed by a top wall 12 which carries a suction valve 50 (see FIG. 1). In the illustrated constructions, the piston 10 is obtained in a single piece.

Figure 2:
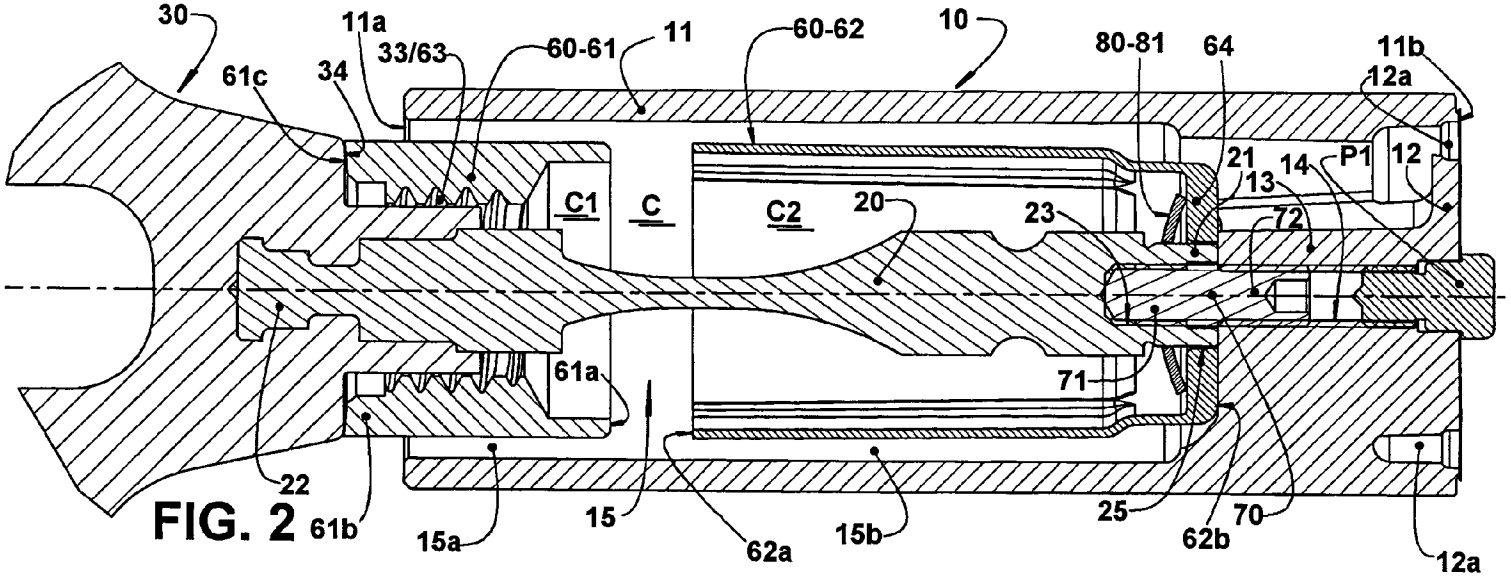
FIG. 2 represents a longitudinal sectional view of the movable assembly illustrated in FIG. 1.

In the illustrated constructions, the cylindrical tubular body 11 and the top wall 12 of the piston 10 can be formed in separate pieces, which can be affixed to one another by an appropriate fixation means, such as glue, welding, or by mechanical interference, or also by a screw P1 (see FIGS. 1 and 2).

The cylindrical tubular body 11 is, for example, defined by a respective steel tube extension, preferably with an external surface hardening treatment, and presents an end edge region including its front end 11*b*, configured to affix the top wall 12.

Since the cylindrical tubular body 11 and the top wall 12, as parts of the piston 10, are separated from each other, each of said parts can be obtained with a specific process and with a material more appropriate to the function to be performed by each of said parts. It should also be understood that the present solution also foresees the possibility of using the same process for obtaining said parts which compose the piston in the present invention, as well as the same material for obtaining both parts which compose the piston 10, these characteristics not being limitative of the present solution.

The rod 20 extends along the interior of the piston 10 and presents a first end 21, affixed to the piston 10 in the region of the top wall 12 thereof, and a second end 22 affixed to the actuating means 30.

According to the constructive forms described herein, as illustrated in the enclosed figures, the fixation between the rod 20 and the piston 10 is carried out through a headless screw or bolt 70, which is initially screwed to the rod 20 and, posteriorly, to the piston 10.

In the illustrated example of fixation, the first end 21 of the rod 20 is provided with an internally threaded axial hole 23 retaining a respective end 71 of a bolt 70, whose opposite end 72 projects outwards from the rod 20, the top wall 12 of the piston 10 incorporating, turned to the interior of the cylindrical tubular body 11 of the latter, a tubular hub 13, axially projecting and provided with an inner thread 14, in which is threaded the opposite end 72 of the bolt 70. One of the possible variations of the constructive solution described above comprises the use of a threaded end, which is machined at the end 21 of the rod 20, eliminating the need for the bolt 70.

In the constructions illustrated herein, the suction of the refrigerant fluid occurs through the piston 10. For these constructions, the top wall 12 of the piston 10 presents suction openings 12*a* that are selectively closed by the suction valve 50, which is mounted to an outer face of said top wall 12.

According to a constructive form of the present invention, in the interior of the piston 10 is housed a suction muffler 60 (or noise muffler) comprising two tubular inserts 61, 62, longitudinally disposed in the interior of the piston 10, around the rod 20 and having open adjacent ends 61*a*, 62*a*, spaced from each other, and closed opposite ends 61*b*, 62*b* respectively affixed to the first end 21 of the rod 20 and to one of the parts defined by the second end 22 of the rod 20 and by the actuating means 30.

In both illustrated embodiments, it is provided an annular passage 15 which comprises a first annular passage portion 15*a* defined by a radial spacing between a first insert 61, of the two tubular inserts 61, 62, adjacent to the actuating means 30, and the cylindrical tubular body 11 of the piston 10.

According to the embodiment illustrated in FIGS. 1 and 2, a second insert 62, of the two tubular inserts 61, 62, adjacent to the top wall 12 of the piston 10, also defines a radial spacing in relation to the cylindrical tubular body 11 of the piston 10. In this constructive solution, the annular passage 15 comprises a second annular passage portion 15*b* defined by the radial spacing between the second tubular insert 62, adjacent to the top wall 12 of the piston 10, and the cylindrical tubular body 11 of the piston 10.

Also according to the embodiment illustrated in FIGS. 1 and 2, the muffling chamber C comprises a first chamber portion C1, defined in the interior of the first tubular insert 61, and a second chamber portion C2, defined in the interior of the second tubular insert 62, said first and second chamber portions C1, C2 being closed at their opposite ends and opened at their adjacent ends defined in the region of the adjacent ends 61*a*, 62*a* of the two tubular inserts 61, 62.

In the embodiment of FIGS. 1 and 2, the annular passage 15 has the first and the second annular passage portion 15*a*, 15*b* longitudinally aligned to each other and defined externally to the two tubular inserts 61, 62, and to the first and the second chamber portion C1, C2 which define the muffling chamber C. This alignment between the two annular passage portions 15*a*, 15*b* has the advantageous aspect of reducing load losses in the gas flow being drawn to the compression chamber of the compressor, through the interior of the tubular body 11 of the piston 10.

Figure 3:
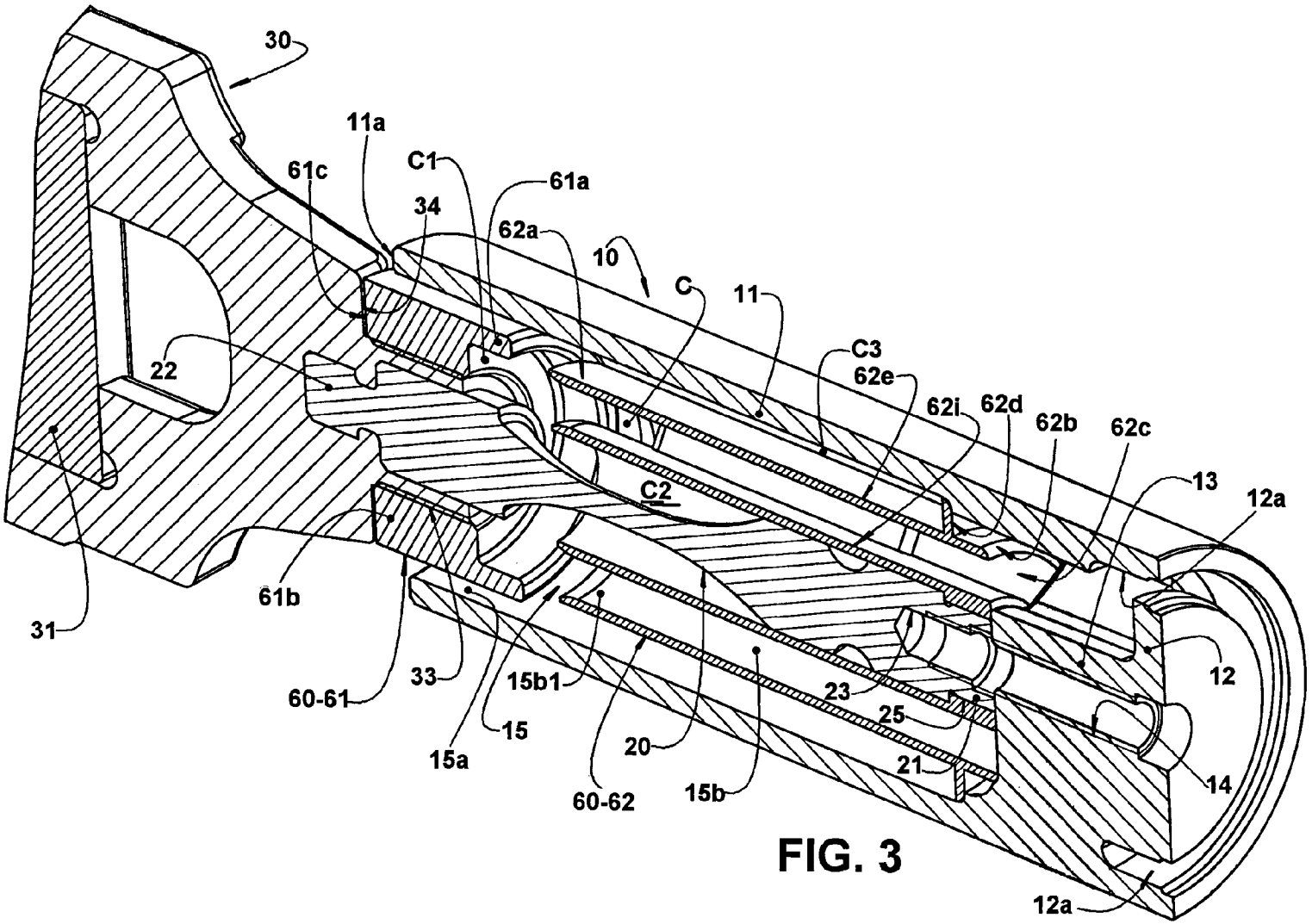
FIG. 3 represents a partially cut schematic perspective view of the movable assembly of a linear compressor, whose piston is internally provided with a suction muffler, constructed according to a second embodiment of the present invention.
Figure 4:
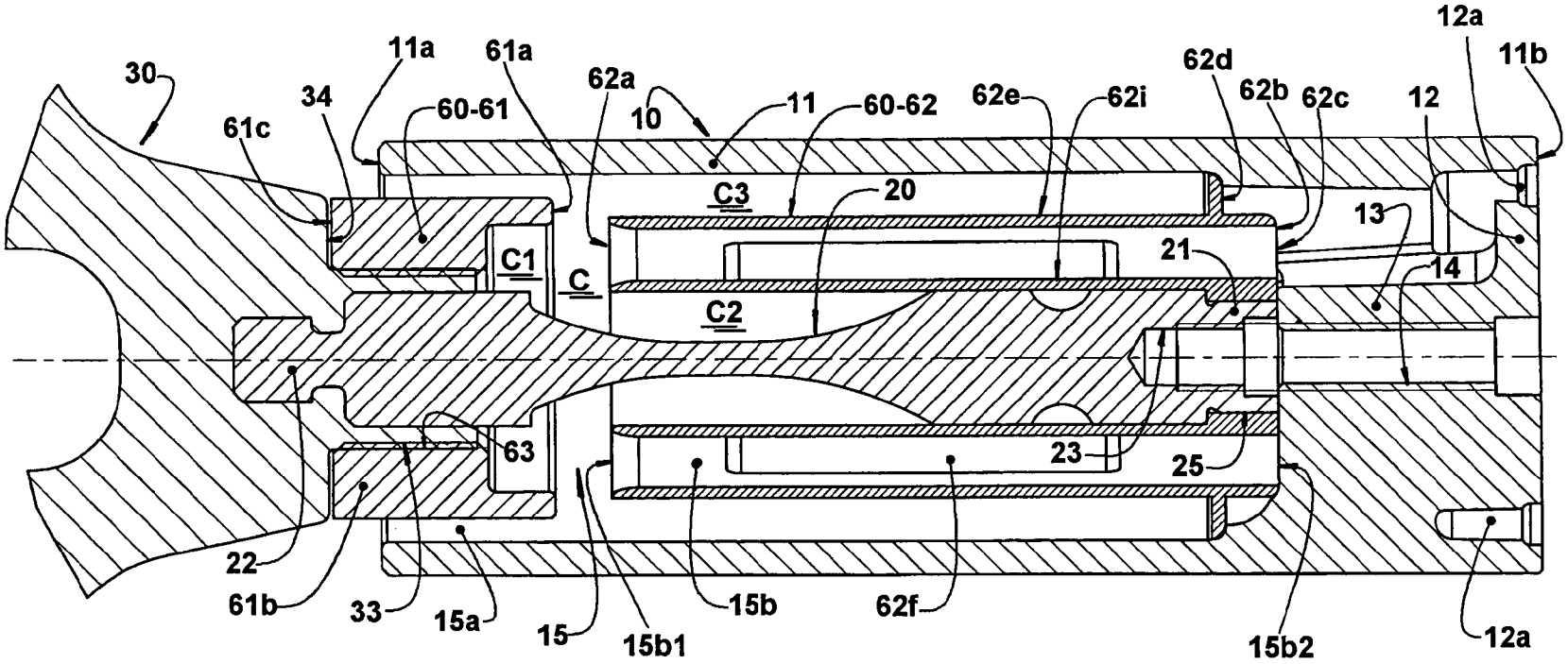
FIG. 4 represents a longitudinal sectional view of the movable assembly illustrated in FIG. 3.

According to the embodiment illustrated in FIGS. 3 and 4, the second tubular insert 62, adjacent to the top wall 12 of the piston 10, comprises an external tubular wall 62*e* and an internal tubular wall 62*i*, radially spaced from each other, the annular passage 15 having its second annular passage portion 15*b* defined between said external tubular wall 62*e* and internal tubular wall 62*i* of the second tubular insert 62, and having a first end 15*b*1 opened to the muffling chamber C and a second end 15*b*2 opened to the suction valve 50, through an annular window 62*c* provided in the closed opposite end 62*b* of the second tubular insert 62, between the internal tubular wall 62*i* and the external tubular wall 62*e* of the latter.

In the illustrated construction, the internal tubular wall 62*i* and external tubular wall 62*e* of the second tubular insert 62 are affixed to each other by a plurality of longitudinal radial fins 62*f*, which are angularly spaced from each other so as not to impair the gas flow to be drawn to the interior of the compression chamber.

Also according to the embodiment of FIGS. 3 and 4, the muffling chamber C comprises a first chamber portion C1 defined in the interior of the first tubular insert 61, a second chamber portion C2 defined in the interior of the internal tubular wall 62*i* of the second tubular insert 62, around the rod 20, and a third chamber portion C3 defined by a radial spacing between the external tubular wall 62*e* of the second tubular insert 62 and the cylindrical tubular body 11 of the piston 10, and closed at its end turned to the top wall 12 of the piston 10, said chamber portions C1, C2, C3 being open in the adjacent ends 61*a*, 62*a* of the tubular inserts 61, 62. In the illustrated construction, the third chamber portion C3 has its end, which is turned to the top wall 12 of the piston 10, closed by an outer annular flange 62*d* incorporated to the external tubular wall 62*e* and which is seated against the cylindrical tubular body 11 of the piston 10.

In the second embodiment illustrated in FIGS. 3 and 4, the two annular passage portions 15*a*, 15*b*, present a longitudinal misalignment which provides a condition in which the gas passage is spaced from the piston wall, which is usually in a higher temperature due to the gas compression. Thus, the gas flow to be admitted in the interior of the compression chamber of the compressor becomes less susceptible to heating, preventing efficiency losses of the compressor.

It should be understood that, while the constructive form for affixing the rod 20 to the piston 10 through a bolt has been described herein, other constructive forms can be used, which do not affect the construction and assembly of the present piston, neither the assembly and fixation of any noise muffler in the interior of said piston.

According to the present invention, the first insert 61 has its closed opposite end 61*b* hermetically seated and affixed to the actuating means 30. In this construction, the closed opposite end 61*b* of the first insert 61 presents an annular end edge 61*c*, to be hermetically seated against an annular wall 34 provided in the actuating means 30, and an inner thread portion 63, to be engaged to a respective thread portion 33 provided in the actuating means 30. The annular end edge 61*c* can be seated against the annular wall 34 of the actuating means 30, through an adequate sealing means which can guarantee the desired tightness.

The fixation of the first tubular insert 61 is obtained by a thread, which is over-injected onto the actuating means 30 itself, which is generally provided in aluminum. Also according to the present invention, the second tubular insert 62 has its closed opposite end 62*b* hermetically compressed and retained between the tubular hub 13 of the piston 10 and the first end 21 of the rod 20. In this construction, the closed opposite end 62*b* of said second tubular insert 62 is compressed against at least one of the parts of tubular hub 13 and of first end 21 of the rod 20, by an intermediary elastic element 80, surrounding a lowered circumferential portion 25 of the rod 20.

In the illustrated mounting arrangement, the second tubular insert 62 has its closed opposite end 62*b* defined, for example, by an annular wall 64, presenting an inner peripheral region surrounding the lowered circumferential portion 25 of the rod 20.

The intermediary elastic element 80 can be defined by one or more flexible elements. In the embodiment illustrated in FIGS. 1 and 2, the intermediary elastic element takes the form of an elastic washer 81 disposed around the lowered circumferential portion 25 of the rod 20 and against which is seated the annular wall 64 of the second tubular insert 62.

Figure 2A:
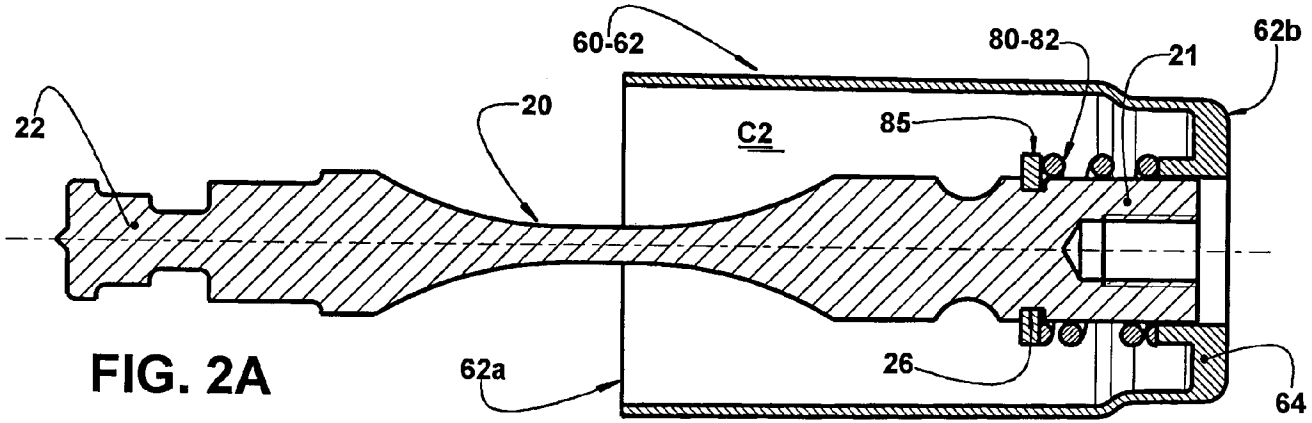
FIG. 2A represents a sectional view, similar to that of FIG. 2, but illustrating only the rod and the second tubular insert, which are mounted with the aid of an elastic means defined by a helical spring.

As illustrated in FIG. 2A, the intermediary elastic element 80 can take the form of a helical spring 82 disposed around the first end 21 of the rod 20 and having an end seated against the end annular wall 64 of the second tubular insert 62 and the other end seated against a retaining elastic ring 85, fitted in a circumferential groove 26 of the rod 20.

The fixation of the second tubular insert 62 is obtained by affixing the rod 20 to the piston 10, using the joining force existing between said two components. It can be also provided a flat washer (not illustrated) between the elastic washer 81 and the end annular wall 64 of the second tubular insert 62, with the function of avoiding a punctual contact between the elastic washer 81 and the end annular wall 64 of the second insert 62, which is, for example, made of plastic, thus avoiding the occurrence of the creeping a phenomenon known as creeping. The elastic washer 81, or the helical spring 82, has the function of exerting a permanent force of affixing the second tubular insert 62 against the piston 10.

According to an illustrated constructive form, the inner peripheral region of the end annular wall 64 of the second insert 62 and the intermediary elastic element 80 are seated in the interior of the lowered circumferential portion 25.

In the particular illustrated form, the lowered circumferential portion 25 is defined by a diametrical reduction produced in the first end 21 of the rod 20, adjacent to the seating region of said first end 21 against an end face of the tubular hub 13 of the top wall of the piston 10. However, it should be understood that the lowered circumferential portion 25 can also include a recess in the tubular hub 13. Besides, it should be also considered that the closed opposite end 62*b* of the second tubular insert 62 can be positioned between the end annular face of the first end 21 of the rod 20 and the end face of the tubular hub 13, directly in contact with an adjacent portion of the bolt 70, which closed opposite end 62*b* can be affixed by a thread, directly to said tubular hub 13, or by directly compressing one of said parts of rod 20 and of tubular hub 13, one against the other, as illustrated in FIG. 4. In this case, it is not necessary to provide the intermediary elastic element 80 between the parts being mounted. The illustrated preferred form, in which the bolt 70 only affixes, directly, the rod 20 and the top wall 12, has the advantage of making possible, with a simple and cheap component easily found in the market, to join the parts during the mounting process. Besides, it also allows, posteriorly, mounting the suction valve by means of the screw P1.

It should be observed that the construction and the assembly of each of the tubular inserts 61, 62 described herein do not depend on each other.

According to a constructive form illustrated for the tubular inserts 61, 62, the adjacent ends 61*a*, 62*a* of the two tubular inserts 61, 62 are mutually confronting. In particular, the two illustrated tubular inserts 61, 62 are cylindrical, concentric to each other and to the piston 10, and present equal or different diameters, as already previously commented.

Nevertheless, it should be understood that the present invention can also consider a piston, in whose interior are mounted two tubular inserts 61, 62 of different diameters and having their adjacent ends 61*a*, 62*a* spaced from each other, but not in a confronting manner, as in the case of said inserts being loosely telescopically mounted to each other.

The illustrated mounting arrangement has the advantage of not requiring very tight tolerances for injected pieces, and the telescopic mounting has the advantage of providing some type of adjustment or tuning during the mounting process.

It should be also observed that the tubular inserts can present variations in the constructive and mounting forms thereof, according to the desired acoustic function, adjustment of tuning mass, facility in manufacturing and mounting said inserts in the interior of the piston. Said alterations do not impair the more generic concept presented herein for a muffler provided in multiple pieces and mounted in the interior of the piston, so as not to affect the functionality of the elements which define the movable assembly of the compressor.

Although embodiments in which the actuating means 30 is connected to the piston 10 by a rod 20 internal to the piston 10 have been illustrated herein, it should be understood that the actuating means 30 can be connected directly to the open rear end 11*a* of the piston 10, when the rod 20, if existent, is not provided in the interior of the piston 10.

In this construction (not illustrated), the suction muffler 60 also comprises the same two tubular inserts 61, 62, illustrated in FIGS. 1 to 4, equally disposed in the interior of the piston 10 and having the adjacent ends 61*a*, 62*a* opened and spaced from each other, and the closed opposite ends 61*b*, 62*b* respectively affixed to the top wall of the piston 12 and to the actuating means 30, by means of constructions which are, if not identical, very similar to those previously described with reference to the enclosed drawings.

Independently of the existence of the rod 20 in the interior of the piston 10, the present noise muffler is of the tube-volume-tube type, the first tube being defined by the first annular passage portion 15*a* existing between the cylindrical tubular body 11 of the piston 10 and the first insert 61, and the second tube being defined by the second annular passage portion 15*b*, which can be formed between the cylindrical tubular body 11 of the piston 10 and the second tubular insert 62, or between the internal tubular wall 62*i* and external tubular wall 62*e* of the second tubular insert 62. The volume is defined by the muffling chamber C formed by a first chamber portion C1 and a second chamber portion C2 formed, respectively, in the interior of the first and second tubular insert 61, 62, according to a first embodiment of the invention. In a second embodiment, the muffling chamber C is formed by a first chamber portion C1 and a second chamber portion C2 formed, respectively, in the interior of the first and second tubular insert 61, 62 and also by a third chamber portion C3 formed between the cylindrical tubular body 11 of the piston 10 and the external tubular wall 62*e* of the second tubular insert 62.

The suction muffler mounted in the interior of the piston, according to the present invention, also has a tuning mass function.

Since it is a resonant system, the linear compressor requires, in determined moments, the addition of an extra mass in the movable assembly, in a way as to reduce the variability of the natural resonance frequency of the system. With the present construction for the piston 10, it is possible to carry out said mass addition by replacing the material of at least one of the tubular inserts 61, 62, by a material with the desired density for the tuning to be reached. In a constructive way of achieving this tuning, one of the tubular inserts 61, 62 can be obtained in a material with a density higher than that of the plastic, such as steel, for example. In the situation in which adjusting the tuning mass is not necessary, both the tubular inserts 61, 62 can have the same material, for example, presenting a low density, such as plastic, thus not altering the characteristics already adjusted in the compressor.

The invention claimed is:

1. A mounting arrangement for a suction muffler in a linear motor compressor of the type which comprises a movable assembly formed by: a piston having a cylindrical tubular body with an open rear end and a front end closed by a top wall which carries a suction valve; and an actuating means connected to the piston to drive the latter in a reciprocating movement, the mounting arrangement being characterized in that the piston houses, internally, a suction muffler comprising two tubular inserts longitudinally disposed in the interior of the piston, said tubular inserts having open adjacent ends spaced from each other and closed opposite ends respectively affixed to the top wall of the piston and to the actuating means, said tubular inserts defining, in the interior of the cylindrical tubular body of the piston, a muffling chamber (C) and an annular passage medianly opened to the muffling chamber (C), through the adjacent ends of the tubular inserts, and communicating the open rear end of the piston with its suction valve.

2. The mounting arrangement, as set forth in claim 1, characterized in that the annular passage comprises a first annular passage portion defined by a radial spacing between a first of the tubular inserts, adjacent to the actuating means, and the cylindrical tubular body of the piston.

3. The mounting arrangement, as set forth in claim 2, characterized in that the annular passage comprises a second annular passage portion defined by a radial spacing between a second of the tubular inserts, adjacent to the top wall of the piston, and the cylindrical tubular body of the piston.

4. The mounting arrangement, as set forth in claim 3, characterized in that the muffling chamber (C) comprises a first chamber portion (C1) defined in the interior of the first tubular insert and a second chamber portion (C2) defined in the interior of the second tubular insert.

5. The mounting arrangement, as set forth in claim 2, characterized in that a second of the tubular inserts comprises an external tubular wall and an internal tubular wall, radially spaced from each other, the annular passage comprising a second annular passage portion defined between said external tubular wall and internal tubular wall of the second tubular insert and having a first end opened to the muffling chamber (C) and a second end opened to the suction valve.

6. The mounting arrangement, as set forth in claim 5, characterized in that the muffling chamber (C) comprises a first chamber portion (C1) defined in the interior of the first tubular insert, a second chamber portion (C2) defined in the interior of the internal tubular wall of the second tubular insert, around the rod, and a third chamber portion (C3) defined by a radial spacing between the external tubular wall of the second tubular insert and the cylindrical tubular body of the piston and closed in its end turned to the top wall of the piston OK said chamber portions (C1, C2, C3) being open in the adjacent ends of the tubular inserts.

7. The mounting arrangement, as set forth in claim 6, characterized in that the third chamber portion (C3) has its end, which is turned to the top wall of the piston, closed by an outer annular flange, incorporated to the external tubular wall and which is seated against the cylindrical tubular body of the piston.

8. The mounting arrangement, as set forth in claim 7, characterized in that a first of the tubular inserts has its closed opposite end hermetically seated on and affixed to the actuating means.

9. The mounting arrangement, as set forth in claim 8, characterized in that the closed opposite end of the first tubular insert presents an annular end edge, to be hermetically seated against a annular wall provided in the actuating means, and an inner thread portion to be engaged with a respective thread portion provided in the actuating means.

10. The mounting arrangement, as set forth in claim 9, the compressor being provided with a rod internal to the piston and having a first end affixed to the piston, in the region of the top wall, and a second end affixed to the actuating means, the mounting arrangement being characterized in that the two tubular inserts, are disposed around the rod and have their closed opposite ends respectively affixed to the top wall of the piston by means of the first end of the rod, and to one of the parts defined by the second end of the rod and by the actuating means.

11. The mounting arrangement, as set forth in claim 10, the first end of the rod being provided with an internally threaded axial hole retaining a respective end of a bolt, whose opposite end projects outwards from the rod, the top wall of the piston incorporating, in the interior of the body of the latter, a tubular hub, axially projecting and provided with an inner thread, in which is threaded the opposite end of the bolt, the piston being characterized in that a second of said tubular inserts has its closed opposite end hermetically compressed and retained between the tubular hub and the first end of the rod.

12. The mounting arrangement, as set forth in claim 11, characterized in that the closed opposite end of said second tubular insert is compressed against at least one of said parts of tubular hub and first end of the rod, by an intermediary elastic element, surrounding the second end of the rod.

13. The mounting arrangement, as set forth in claim 12, characterized in that the closed opposite end of said second tubular insert is defined by an end annular wall, presenting an inner peripheral region surrounding the first end of the rod, the intermediary elastic element and the inner peripheral region of the end annular wall being seated in the interior of a lowered circumferential portion provided at the first end of the rod and of tubular hub of the top wall.

14. The mounting arrangement, as set forth in claim 13, characterized in that the intermediary elastic element comprises an elastic washer, disposed around the first end of the rod and against which is seated an end annular wall of the second tubular insert.

15. The mounting arrangement, as set forth in claim 13, characterized in that the intermediary elastic element takes the form of a helical spring disposed around the first end of the rod and having an end seated against the end annular wall of the second tubular insert and the other end seated against a retaining elastic ring, fitted in a circumferential groove of the rod.

16. The mounting arrangement, as set forth in claim 15, characterized in that the adjacent ends of the two tubular inserts are mutually confronting.

17. The mounting arrangement, as set forth in claim 4, characterized in that the first tubular insert has its closed opposite end hermetically seated on and affixed to the actuating means.

18. The mounting arrangement, as set forth in claim 17, characterized in that the closed opposite end of the first tubular insert presents an annular end edge, to be hermetically seated against a annular wall provided in the actuating means, and an inner thread portion to be engaged with a respective thread portion provided in the actuating means.

19. The mounting arrangement, as set forth in claim 18, wherein the compressor is being provided with a rod internal to the piston and having a first end affixed to the piston, in the region of the top wall, and a second end affixed to the actuating means, the mounting arrangement being characterized in that the two tubular inserts, are disposed around the rod and have their closed opposite ends respectively affixed to the top wall of the piston, by means of the first end of the rod, and to one of the parts defined by the second end of the rod and by the actuating means.

20. The mounting arrangement, as set forth in claim 19, wherein the first end of the rod includes an internally threaded axial hole retaining a respective end of a bolt, an opposite end of the bolt projects outwards from the rod, the top wall of the piston incorporating, in the interior of the body of the latter, a tubular hub, axially projecting and provided with an inner thread, in which is threaded the opposite end of the bolt, the piston being characterized in that a second of said tubular inserts has its closed opposite end hermetically compressed and retained between the tubular hub and the first end of the rod.

21. The mounting arrangement, as set forth in claim 20, characterized in that the closed opposite end of said second tubular insert is compressed against at least one of said parts of tubular hub and first end of the rod, by an intermediary elastic element, surrounding the second end of the rod.

22. The mounting arrangement, as set forth in claim 21, characterized in that the closed opposite end of said second tubular insert is defined by an end annular wall, presenting an inner peripheral region surrounding the first end of the rod, the intermediary elastic element and the inner peripheral region of the end annular wall being seated in the interior of a lowered circumferential portion provided at the first end of the rod and of tubular hub of the top wall.

23. The mounting arrangement, as set forth in claim 21, characterized in that the intermediary elastic element comprises an elastic washer, disposed around the first end of the rod and against which is seated an end annular wall of the second tubular insert.

24. The mounting arrangement, as set forth in claim 23, characterized in that the intermediary elastic element takes the form of a helical spring disposed around the first end of the rod and having an end seated against the end annular wall of the second tubular insert and the other end seated against a retaining elastic ring, fitted in a circumferential groove of the rod.

25. The mounting arrangement, as set forth in claim 24, wherein the adjacent ends of the two tubular inserts are mutually confronting.

* * * * *